US007301516B2

(12) United States Patent
Baek

(10) Patent No.: US 7,301,516 B2
(45) Date of Patent: Nov. 27, 2007

(54) DISPLAY DEVICE AND METHOD OF DRIVING THE SAME

(75) Inventor: Heum-Il Baek, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 659 days.

(21) Appl. No.: 10/872,416

(22) Filed: Jun. 22, 2004

(65) Prior Publication Data

US 2005/0140614 A1 Jun. 30, 2005

(30) Foreign Application Priority Data

Dec. 29, 2003 (KR) ..... 10-2003-0098681

(51) Int. Cl.
*G09G 3/36* (2006.01)

(52) U.S. Cl. ..... 345/87; 345/88; 345/89; 345/100; 345/204; 345/690

(58) Field of Classification Search ..... 345/77, 345/87–89, 48, 32, 63, 600, 690–693, 204
See application file for complete search history.

(56) References Cited

U.S. PATENT DOCUMENTS 5,929,843 A * 7/1999 Tanioka ..... 345/600
6,954,191 B1 * 10/2005 Hirano et al. ..... 345/77

FOREIGN PATENT DOCUMENTS

| | | |
|---|---|---|
| CN | 1291849 A | 4/2001 |
| JP | 11-174583 A | 7/1999 |
| JP | 11-321901 | 11/1999 |

* cited by examiner

*Primary Examiner*—Richard Hjerpe
*Assistant Examiner*—Jennifer T Nguyen
(74) *Attorney, Agent, or Firm*—Morgan, Lewis & Bockius LLP

(57) ABSTRACT

A display device includes a comparing portion extracting a minimum value and a maximum value of red, green, blue source image data signals, a first extracting portion extracting an intermediate signal from the minimum value and extracting a white image data signal from the intermediate signal, a second extracting portion extracting a red image data signal from the intermediate signal, the maximum data signal, and the red source image data signal, a third extracting portion extracting a green image data signal from the intermediate signal, the maximum data signal, and the green source image data signal, a fourth extracting portion extracting a blue image data signal from the intermediate signal, the maximum data signal, and the blue source image data signal, and a display panel having a plurality of pixels including red, green, blue, and white sub-pixels supplied with the red, green, blue, and white image data signals, respectively.

28 Claims, 5 Drawing Sheets

DISPLAY DEVICE AND METHOD OF DRIVING THE SAME

The present invention claims the benefit of Korean Patent Application No. 2003-98681, filed in Korea on Dec. 29, 2003, which is hereby incorporated by reference.

BACKGROUND OF THE INVENTION

1. Field of the Invention

The present invention relates to a display device and a method of driving a display device, and more particularly, to a liquid crystal display (LCD) device and a method of driving an LCD device.

2. Discussion of the Related Art

In general, an LCD device includes two substrates that are spaced apart and face each other, and a liquid crystal material layer interposed between the two substrates. Each of the substrates includes electrodes that face each other, wherein a voltage supplied to each of the electrodes induces an electric field to the liquid crystal material layer. Accordingly, alignment of liquid crystal molecules of the liquid crystal material layer is changed by varying an intensity or direction of the induced electric field, thereby changing light transmissivity through the liquid crystal material layer. Thus, the LCD device displays images by varying the induced electric field.

The LCD device displays images using a plurality of pixels arranged in a matrix configuration. In general, each of the pixels has red, green, and blue sub-pixels that produce red, green, and blue colored light, respectively.

Currently, an RGBW-type LCD device has been used, wherein pixels include red, green, blue, and white sub-pixels to additionally produce white colored light to increase luminance of displayed images. Accordingly, color purity (or color saturation) of displayed images including the white colored light is less than a color purity of images displayed without the white colored light. In addition, the color purity of the images displayed using the white colored light includes halftones of the original images displayed without the white colored light.

By way of example, JP11-321901 discloses an LCD device and driving method thereof for preventing reduction of original images when the display device further has a white sub-pixel. According to JP11-321901, ratios of red, green, and blue color input luminance data corresponding to original images are the same as ratios of red, green, and blue color output luminance data corresponding to displayed images as following:

$$Ri:Gi:Bi=(Ro+Wo):(Go+Wo):(Bo+Wo)$$

wherein Ri, Gi, and Bi are red, green, and blue input data, respectively, and Ro, Go, Bo, and Wo are red, green, blue, and white output data, respectively. Accordingly, although the LCD device further includes a white sub-pixel, color purity of original images remains unchanged.

FIG. 1 is a diagram demonstrating a relationship between gray level and luminance of RGB, W, and RGB+W gamma curves according to the related art. As shown in FIG. 1, the RGB gamma curve represents red, green, and blue data, the W gamma curve represents white data, and the RGB+W gamma curve represents red, green, blue, and white data when gray levels are between 0 to 255.

In FIG. 1, the RGB gamma curve is produced when a gamma value is about 2.5, and red, green, and blue data have gamma values of about 2.5. However, as the white sub-pixel is added, gamma values are changed from about 2.5 to about 2.8. Accordingly, the RGB+W gamma curve is a combination of the RGB and W gamma curves.

As shown in FIG. 1, when the gray level is more than about a $150^{th}$ level, a slope of the RGB+W gamma curve increases as compared to the RGB gamma curve. Accordingly, when the gray level is more than about the $150^{th}$ level, a luminance difference between gray levels along the RGB+W gamma curve is larger than a luminance difference between gray levels along the RGB gamma curve. Thus, images with high gray levels greater than the $150^{th}$ level are distinctly displayed.

However, as shown in FIG. 1, when the gray level is less about the $150^{th}$ level, a luminance difference between the gray levels along the RGB+W gamma curve is smaller than a luminance difference between the gray levels along RGB gamma curve. Thus, images with low gray levels less than the $150^{th}$ level are not distinctly displayed. Therefore, it is problematic that the difference between the gray levels along the RGB+W gamma curve is smaller than the difference between the gray levels along RGB gamma curve when the gray level is less than about the $150^{th}$ level. For example, regions of an image having high gray levels, such as bright colors, are distinctly displayed, but regions of the image having low gray levels, such as dark colors, are not distinctly displayed.

SUMMARY OF THE INVENTION

Accordingly, the present invention is directed to a display device and method of driving a display device that substantially obviates one or more of problems due to limitations and disadvantages of the related art.

An object of the present invention is to provide a display device that prevents display of indistinct images having low gray levels.

Another object of the present invention is to provide a method of driving a display device to produce distinct images having low gray levels.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a display device includes a comparing portion extracting a minimum value and a maximum value of red, green, blue source image data signals, a first extracting portion extracting an intermediate signal from the minimum value and extracting a white image data signal from the intermediate signal, a second extracting portion extracting a red image data signal from the intermediate signal, the maximum data signal, and the red source image data signal, a third extracting portion extracting a green image data signal from the intermediate signal, the maximum data signal, and the green source image data signal, a fourth extracting portion extracting a blue image data signal from the intermediate signal, the maximum data signal, and the blue source image data signal, and a display panel having a plurality of pixels including red, green, blue, and white sub-pixels supplied with the red, green, blue, and white image data signals, respectively.

In another aspect, a method of driving a display device includes extracting a minimum value and a maximum value of red, green, blue source image data signals, extracting an intermediate signal from the minimum value, extracting a white image data signal from the intermediate signal, extracting a red image data signal from the intermediate signal, the maximum data signal, and the red source image data signal, extracting a green image data signal from the intermediate signal, the maximum data signal, and the green source image data signal, extracting a blue image data signal from the intermediate signal, the maximum data signal, and the blue source image data signal, and supplying the red, green, blue, and white image data signals to a plurality of pixels each including red, green, blue, and white sub-pixels to display images on a display of the display device.

In another aspect, a display device includes a comparing portion extracting a minimum value and a maximum value of red, green, blue source image data signals, a first extracting portion extracting an intermediate signal from the minimum value and extracting a white data signal from the intermediate signal, a plurality of second extracting portions extracting red, green, and blue image data signals from the intermediate signal, the maximum data signal, and the red, green, and blue source image data signals, a display panel having a plurality of pixels, each of the pixels having red, green, blue, and white sub-pixels supplied with the red, green, blue, and white image data signals, respectively.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the illustrated embodiments of the present invention, which are illustrated in the accompanying drawings.

Figure 2:
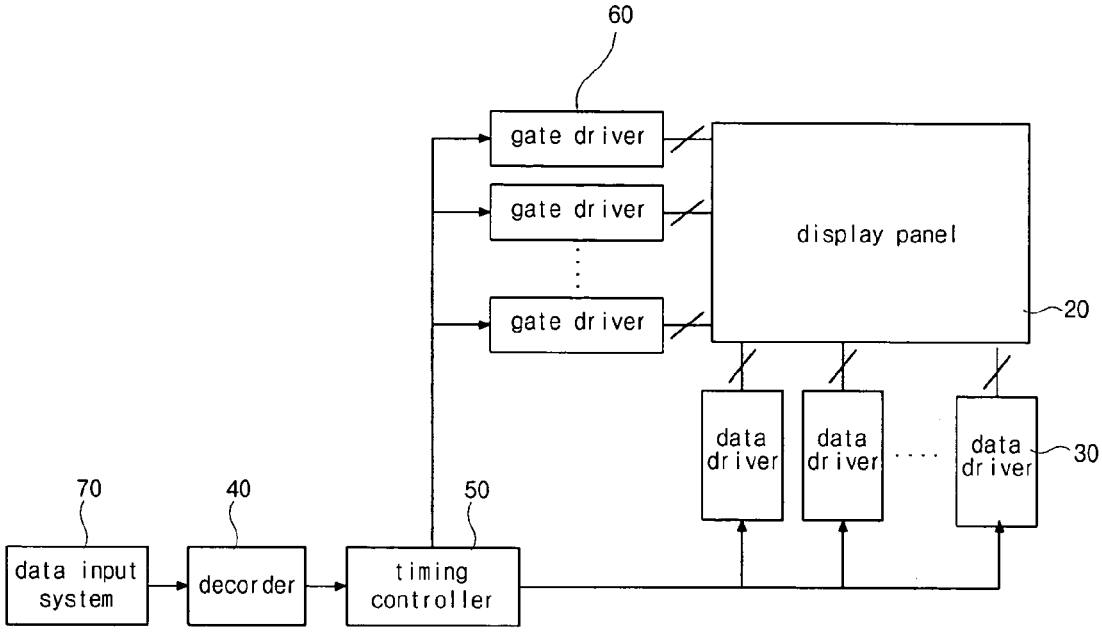
FIG. 2 is a schematic circuit of an exemplary RGBW quad-type LCD device according to the present invention.

FIG. 2 is a schematic circuit of an exemplary RGBW quad-type LCD device according to the present invention. In FIG. 2, an RGBW-type LCD device may include a display panel 20, a plurality of source drivers 30 outputting image data signals to the display panel 20, a decoder 40 outputting image data signals to improve luminance of images displayed by the display panel 20, a timing controller 50 outputting image data signals and control signals to the plurality of source drivers and control signals to a plurality of gate drivers 60, and a data input system 70 inputting source image data signals. Although FIG. 2 shows an LCD display panel 20, the display panel 20 may include almost any type of display device, and is not limited to an LCD display device.

Figure 3:
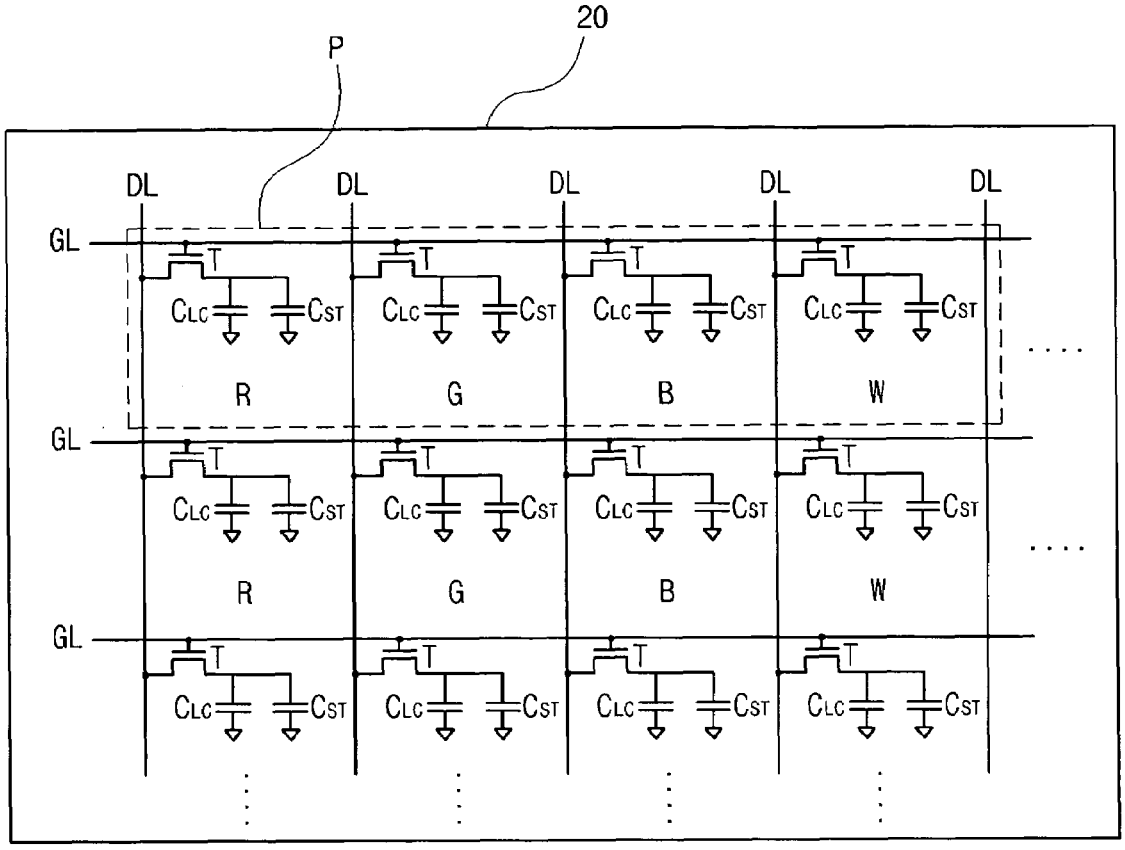
FIG. 3 is a schematic circuit of an exemplary LCD panel of an RGBW-type LCD device according to the present invention.

FIG. 3 is a schematic circuit of an exemplary LCD panel of an RGBW-type LCD device according to the present invention. In FIG. 3, an LCD panel 20 may include a plurality of gate lines GL and a plurality of data lines DL, and a plurality of red, green, blue, and white sub-pixels R, G, B, and W, respectively. The red, green, blue, and white sub-pixels R, G, B, and W may constitute a pixel P. Each of the red, green, blue, and white sub-pixels R, G, B, and W may have a transistor T connected between the gate line GL and the data line DL, and may be disposed at crossing region of the gate line GL and the data line DL. In addition, a pixel capacitor $C_{LC}$ and a storage capacitor $C_{ST}$ may be connected to the transistor T, wherein the pixel capacitor $C_{LC}$ and the storage capacitor $C_{ST}$ may store image data signals to display images.

In FIG. 2, the plurality of gate drivers 60 may sequentially output scanning signals to the gate lines GL (in FIG. 3), and the transistors T (in FIG. 3) that are connected to the gate lines GL (in FIG. 3) may output scanning signals during an ON-state. Accordingly, as shown in FIG. 3, when channel regions of the transistors T are in a conductive ON-state, and image data signals are supplied to the sub-pixels R, G, B, and W through data lines DL.

In FIG. 2, each of the plurality of data drivers 30 may output red, green, blue, and white image data signals to the sub-pixels R, G, B, and W (in FIG. 3), respectively. In addition, each of the plurality of data drivers 30 may have a plurality of latches to latch the image data signals, and may have a digital to analog converter (DAC) to convert digital image data signals into analog image data signals (not shown). The image data signals may be supplied by the timing controller 50, which may be latched by the latches of the plurality of data drivers 30, and the DAC may convert the latched digital image data signals to the analog image data signals. The timing controller 50 may output and control the image data signals to the plurality of data drivers 30, and may control signals output to the plurality of gate drivers 60 in accordance with timing sequence.

In FIG. 2, the data input system 70 may supply the red, green, and blue source image data signals to the decoder 40. Then, the decoder 40 may generate the red, green, blue, and white image data signals from the red, green, and blue source image data signals, respectively.

Figure 4:
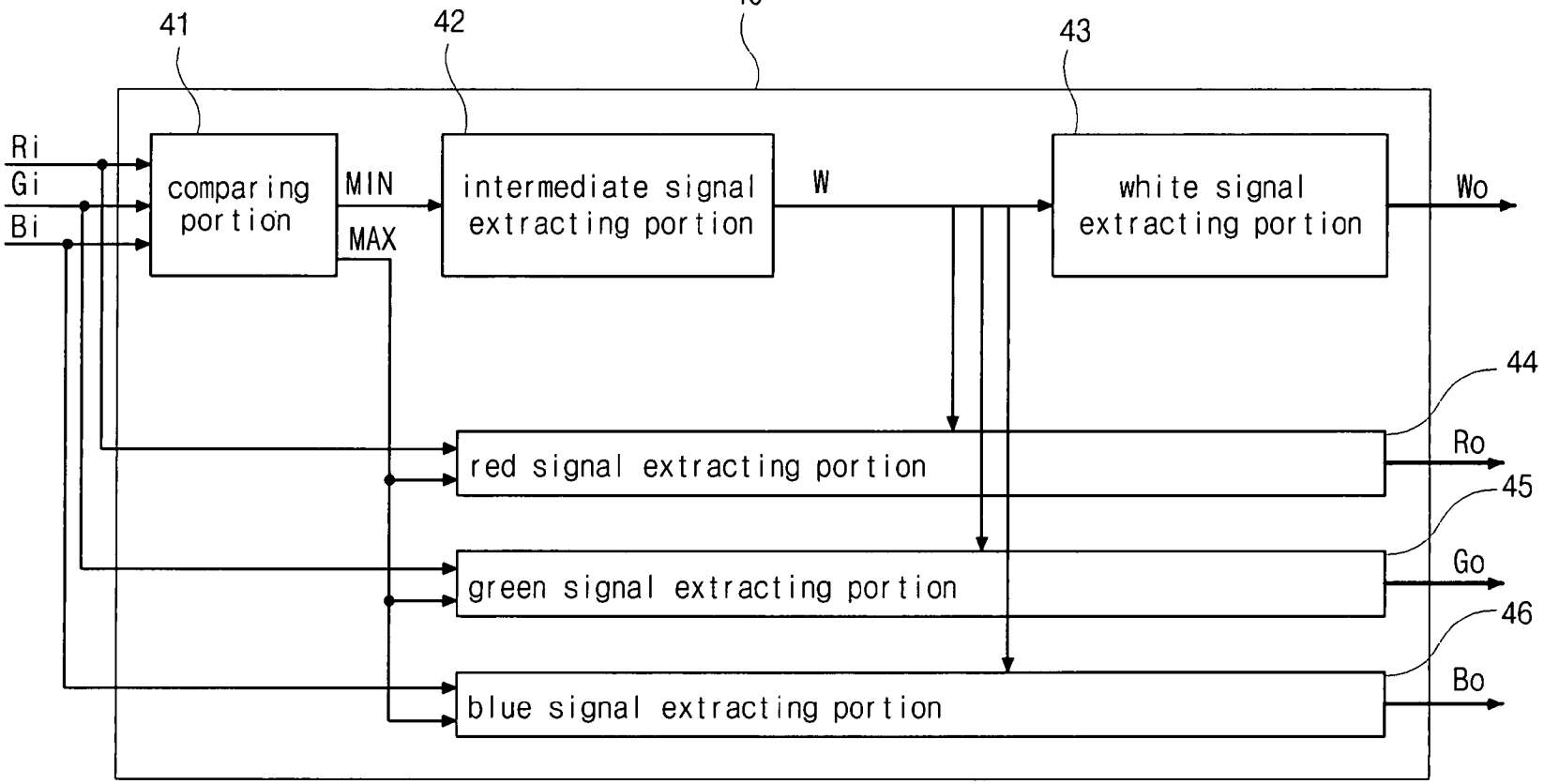
FIG. 4 is a schematic diagram of an exemplary decoder of an RGBW-type LCD device according to the present invention.

FIG. 4 is a schematic diagram of an exemplary decoder of an RGBW-type LCD device according to the present invention. In FIG. 4, a decoder 40 may include a comparing portion 41, an intermediate signal extracting portion 42, a white signal extracting portion 43, a red signal extracting portion 44, a green signal extracting portion 45, a blue signal extracting portion 46. The comparing portion 41 may supply red, green, and blue source image data signals Ri, Gi, and Bi by the data input system 70. In addition, the comparing portion 41 may compare values of the red, green, and blue source image data signals Ri, Gi, and Bi, and may extract a minimum value MIN and a maximum value MAX of the red, green, and blue source image data signals Ri, Gi, and Bi.

The intermediate signal extracting portion 42 may be supplied with the minimum value MIN extracted by the comparing portion 41, and may extract an intermediate signal W from the minimum value MIN. The intermediate signal W may be extracted from the minimum value MIN by a first function, W=f(MIN), wherein the function f(MIN) may be $MIN^k$ (where k is a real number), for example. Alternatively, the intermediate signal W may be extracted by other functions different from the exemplary first function.

The intermediate signal extracting portion 42 may include a first look-up table. Accordingly, the intermediate signal W and the minimum value MIN corresponding to each other may correspond to the first function, W=f(MIN), and may be set in the first look-up table. Thus, the intermediate signal extracting portion 42 may directly extract the intermediate signal W from the minimum value MIN using the first look-up table according to the first function.

In FIG. 4, the intermediate signal extracting portion 42 may supply the intermediate signal W to the white signal extracting portion 43, the red signal extracting portion 44, the green signal extracting portion 45, and the blue signal extracting portion 46. In addition, the red signal extracting portion 44 may extract a red image data signal Ro from the red source image data signal Ri, the intermediate value W, and the maximum value MAX. The red image data signal Ro may be extracted using an exemplary red extracting expression, Ro=Ri*(W+MAX)/MAX−W, wherein Ri may be value of the red source image data signal, and Ro may be a value of the red image data signal. Alternatively, the red image data signal Ro may be extracted using other expressions different from the exemplary red extracting expression.

In FIG. 4, the green signal extracting portion 45 may extract a green image data signal Go from the green source image data signal Gi, the intermediate value W, and the maximum value MAX. The green image data signal Go may be extracted using an exemplary green extracting expression, Go=Gi*(W+MAX)/MAX−W, wherein Gi may be a value of the green source image data signal, and Go may be a value of the green image data signal. Alternatively, the green image data signal Go may be extracted using other expressions different from the exemplary green extracting expression.

In FIG. 4, the blue signal extracting portion 46 may extract a blue image data signal Bo from the blue source image data signal Bi, the intermediate value W, and the maximum value MAX. The blue image data signal Bo may be extracted using an exemplary a blue extracting expression, Bo=Bi*(W+MAX)/MAX−W, wherein Bi may be a value of the blue source image data signal, and Bo may be a value of the blue image data signal. Alternatively, the blue image data signal Bo may be extracted using other expressions different from the exemplary blue extracting expression.

In FIG. 4, the white signal extracting portion 43 may extract a white image data signal Wo from the intermediate signal W using an exemplary second function, Wo=f(W). The exemplary second function f(W) may include $W(TP)(W/W(TP))^{1/\gamma}$ when $0 \leqq W \leqq TP$, and when $TP < W \leqq GLM$, then Wo=W. In the exemplary second function, γ may be a gamma factor to emphasize a gray level, TP may be a target point or an upper limit of a gray level to specifically distinguish between different gray levels less than the target point, W(TP) may be a function value at the target point TP, and GLM may be a maximum gray level. Accordingly, as the gamma factor γ increases, the difference between the gray levels that are less than the target point may become more distinct.

The white signal extracting portion 43 may use a second look-up table. Accordingly, the white image data signal Wo and the intermediate signal W corresponding to each other may correspond to the second function, Wo=f(W), and may be set in the second look-up table. Thus, the white signal extracting portion 43 may directly extract the white image data signal Wo from the intermediate signal W using the second look-up table according to the second function.

Figure 5:
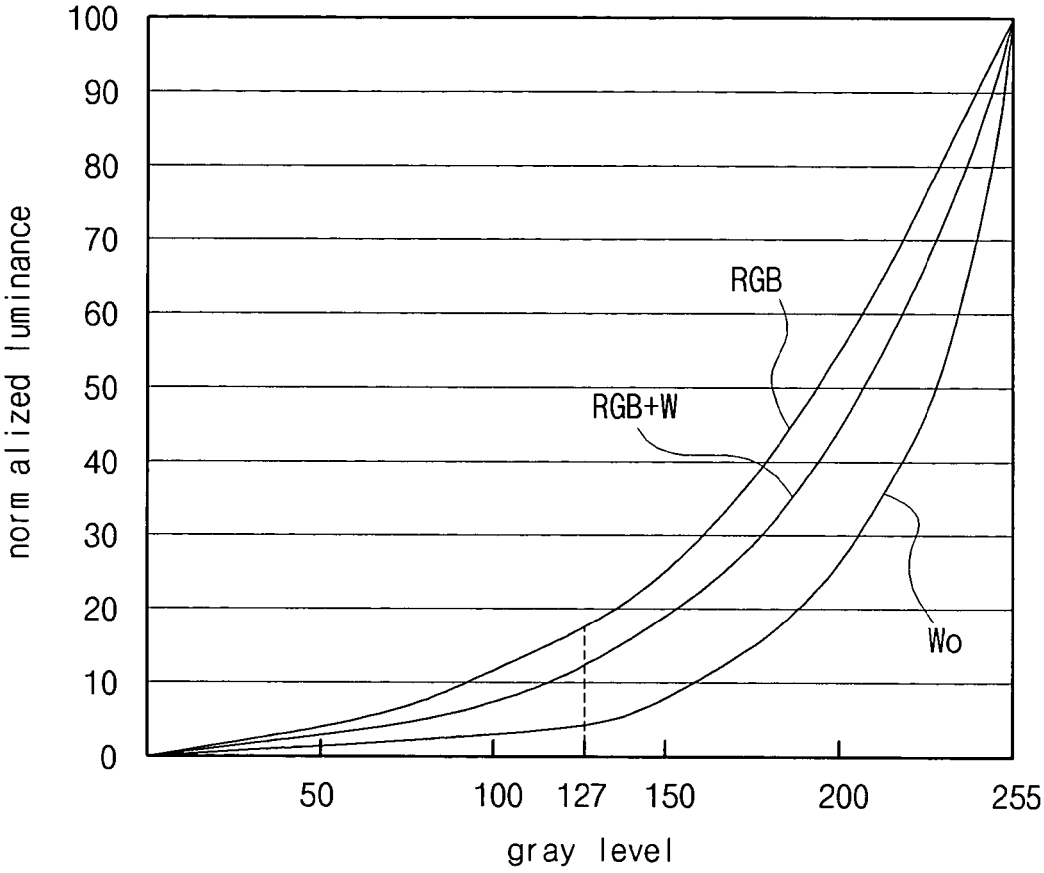
FIG. 5 is a diagram demonstrating a relationship between gray level and luminance view of exemplary RGB, W, and RGB+W gamma curves according to the present invention.

FIG. 5 is a diagram demonstrating a relationship between gray level and luminance view of exemplary RGB, W, and RGB+W gamma curves according to the present invention. As shown in FIG. 5, an RGB gamma curve may represent red, green, and blue data, the Wo gamma curve may represent white data, and the RGB+W gamma curve may represent red, green, blue, and white data when gray levels are between about 0 to about 255.

In FIG. 5, the RGB gamma curve may represent gamma values of about 2.5 for the red, green, and blue data. In addition, the Wo gamma curve may represent results of a second function, Wo=f(W), wherein a target point TP may be about 127, a function value W(TP) at the target point TP may be about 63, and a gamma factor may be about 3. The target point may be defined as an upper limit of a gray level to distinctly distinguish between differences of the gray levels. Accordingly, the RGB+W gamma curve may be generated, as shown in FIG. 5.

Figure 1:
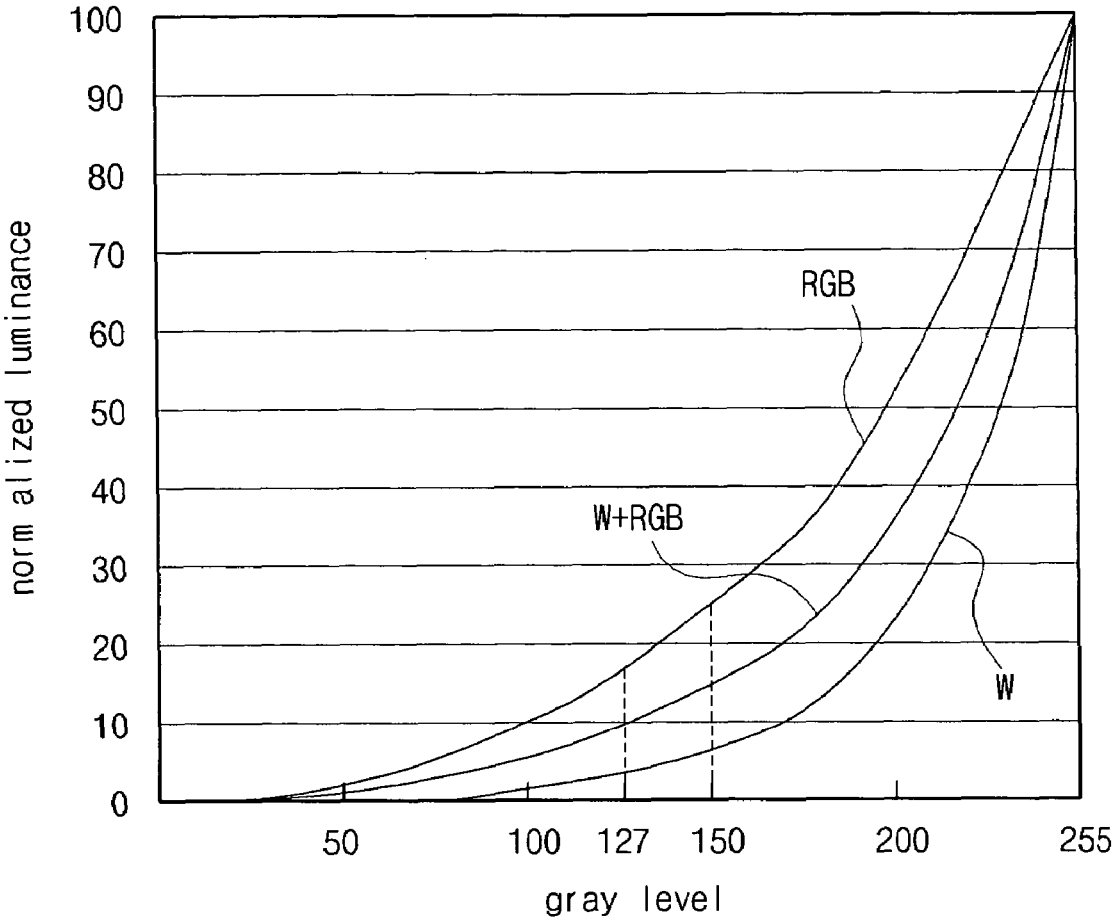
FIG. 1 RELATED ART
FIG. 1 is a diagram demonstrating a relationship between gray level and luminance of RGB, W, and RGB+W gamma curves according to the related art.

Since the target point may be about 127, the Wo gamma curve may slowly increase beneath the target point. Accordingly, a first slope of the RGB+W gamma curve beneath the $127^{th}$ gray level increases more than a second slope of the RGB+W gamma curve beneath the $127^{th}$ gray level. Thus, a luminance difference between gray levels along the RGB+W gamma curve beneath the $127^{th}$ gray level in FIG. 5 is greater than a luminance difference between gray levels along the RGB+W gamma curve beneath the $127^{th}$ gray level in FIG. 1. As a result, images having low gray levels beneath the $127^{th}$ gray level may be distinctly displayed. For example, regions of an image having low gray levels, such as dark colors, may be distinctly displayed.

It will be apparent to those skilled in the art that various modifications and variations can be made in the LCD device and method of driving an LCD device of the present invention without departing from the spirit or scope of the invention. Thus, it is intended that the present invention cover the modifications and variations of this invention provided they come within the scope of the appended claims and their equivalents.

What is claimed is:

1. A display device, comprising:

a comparing portion extracting a minimum value and a maximum value of red, green, blue source image data signals;

a first extracting portion extracting an intermediate signal from the minimum value and extracting a white image data signal from the intermediate signal;

a second extracting portion extracting a red image data signal from the intermediate signal, the maximum data signal, and the red source image data signal;

a third extracting portion extracting a green image data signal from the intermediate signal, the maximum data signal, and the green source image data signal;

fourth extracting portion extracting a blue image data signal from the intermediate signal, the maximum data signal, and the blue source image data signal; and display panel having a plurality of pixels including red, green, blue, and white sub-pixels supplied with the red, green, blue, and white image data signals, respectively, wherein the first extracting portion includes a fifth extracting portion extracting the intermediate signal using a first function, W=f(MIN), wherein W is a value of the intermediate signal and MIN is the minimum value of the red, green, blue source image data signals, and the a sixth extracting portion extracting the white image data signal using a second function, Wo=f(W), wherein Wo is a value of the white image data signal and W is a value of the intermediate signal.

2. The device according to claim 1, wherein the first function is $W=MIN^k$, wherein k is a real number.

3. The device according to claim 1, wherein the second function is $Wo=(TP)(W/W(TP))^{1/\gamma}$, when $0 \leqq W \leqq TP$, wherein TP is an upper limit of a gray level, γ is a gamma factor, W(TP) is a function value at TP, and GLM is a maximum gray level.

4. The device according to claim 1, wherein the second function is Wo=W when $TP<W \leqq GLM$, wherein TP is an upper limit of a gray level, and GLM is a maximum gray level.

5. The device according to claim 1, wherein the fifth extracting portion uses a first look-up table in accordance with the first function, and the sixth extracting portion uses a second look-up table in accordance with the second function.

6. The device according to claim 1, wherein the second extracting portion extracts the red image data signal using an expression, Ro=Ri*(W+MAX)/MAX−W, wherein Ri is a value of the red source image data signal, Ro is a value of the red image data signal, W is a value of the intermediate signal, and MAX is the maximum value of the red, green, and blue source image data signals.

7. The device according to claim 1, wherein the third extracting portion extracts the green image data signal using an expression, Go=Gi*(W+MAX)/MAX−W, wherein Gi is a value of the green source image data signal, Go is a value of the green image data signal, W is a value of the intermediate signal, and MAX is the maximum value of the red, green, and blue image data signals.

8. The device according to claim 1, wherein the fourth extracting portion extracts the blue image data signal using an expression, Bo=Bi*(W+MAX)/MAX−W, wherein Bi is a value of the blue source image data signal, Bo is a value of the blue image data signal, W is a value of the intermediate signal, and MAX is the maximum value of the red, green, and blue source image data signals.

9. The device according to claim 1, further comprises a timing controller to output the red, green, blue, and white image data signals in accordance with a timing sequence.

10. The device according to claim 9, further comprises a plurality of data drivers supplying the red, green, blue, and white image data signals to the red, green, blue, and white sub-pixels, respectively.

11. The device according to claim 1, wherein the display panel is a liquid crystal display panel.

12. A method of driving a display device, comprising:

extracting a minimum value and a maximum value of red, green, blue source image data signals;

extracting an intermediate signal from the minimum value;

extracting a white image data signal from the intermediate signal;

extracting a red image data signal from the intermediate signal, the maximum data signal, and the red source image data signal;

extracting a green image data signal from the intermediate signal, the maximum data signal, and the green source image data signal;

extracting a blue image data signal from the intermediate signal, the maximum data signal, and the blue source image data signal; and supplying the red, green, blue, and white image data signals to a plurality of pixels each including red, green, blue, and white sub-pixels to display images on a display of the display devices, wherein the intermediate signal is extracted using a first function, W=f(MIN), wherein W is a value of the intermediate signal. and MIN is the minimum value of the red, green, blue source image data signals, and the white image data signal is extracted using a second function, Wo=f(W). wherein Wo is a value of the white image data signal.

13. The method according to claim 12, wherein the first function is $W=MIN^k$, wherein k is a real number.

14. The method according to claim 12, wherein the second function is $Wo=(TP)(W/W(TP))^{1/\gamma}$, when $0 \leqq W \leqq TP$ wherein TP is an upper limit of a gray level, γ is a gamma factor, and W(TP) is a function value at TP.

15. The method according to claim 12, wherein the second function is Wo=W when $TP<W \leqq GLM$, wherein TP is an upper limit of a gray level, GLM is a maximum gray level.

16. The method according to claim 12, wherein the intermediate signal is extracted using a first look-up table in accordance with the first function, and the white image data signal is extracted using a second look-up table in accordance with the second function.

17. The method according to claim 12, wherein the red image data signal is extracted using an expression, Ro=Ri*(W+MAX)/MAX−W, wherein Ri is a value of the red source mage data signal, Ro is a value of the red image data signal, W is a value of the intermediate signal, and MAX is the maximum value of the red, green, blue source image data signals.

18. The method according to claim 12, wherein the green image data signal is extracted using an expression, Go=Gi*(W+MAX)/MAX−W, wherein Gi is a value of the green source image data signal, Go is a value of the green image data signal, W is a value of the intermediate signal, and MAX is the maximum value of the red, green, blue source image data signals.

19. The method according to claim 12, wherein the blue image data signal is extracted using an expression, Bo=Bi*(W+MAX)/MAX−W, wherein Bi is a value of the blue source image data signal, Bo is a value of the blue image data signal, W is a value of the intermediate signal, and MAX is the maximum value of the red, green, blue source image data signals.

20. The method according to claim 12, wherein supplying the red, green, blue, and white image data signals includes a sequential timing.

21. The method according to claim 12, wherein the display panel is a liquid crystal display panel.

22. A display device, comprising:

a comparing portion extracting a minimum value and a maximum value of red, green, blue source image data signals;

a first extracting portion extracting an intermediate signal from the minimum value and extracting a white image data signal from the intermediate signal;

a second extracting portions extracting red, green, and blue image data signals from the intermediate signal, the maximum data signal, and the red, green, and blue source image data signals;

a display panel having a plurality of pixels, each of the pixels having red, green, blue, and white sub-pixels supplied with the red, green, blue, and white image data signals, respectively, wherein the first extracting portion extracts the intermediate signal using a first function including the minimum value of the red, green, blue source image data signals, and extracts the white image data signal using a second function including the intermediate signal.

23. The device according to claim 22, wherein the first function is $W=MIN^k$, wherein W is a value of the intermediate signal, k is a real number and MIN is the minimum value of the red, green, blue source image data signals.

24. The device according to claim 22, wherein the second function is $Wo=(TP)(W/W(TP))^{1/\gamma}$, when $0 \leqq W \leqq TP$ wherein Wo is a value of the white image data signal, TP is an upper limit of a gray level, $\gamma$ is a gamma factor, W is a value of the intermediate signal, and W(TP) is a function value at TP.

25. The device according to claim 22, wherein the second function is $Wo=W$, when $TP<W \leqq GLM$, wherein Wo is a value of the white image data signal, W is a value of the intermediate signal, TP is an upper limit of a gray level and GLM is a maximum gray level.

26. The device according to claim 22, further comprises a timing controller to output the red, green, blue, and white image data signals in accordance with a timing sequence.

27. The device according to claim 22, further comprises a plurality of data drivers supplying the red, green, blue, and white image data signals to the red, green, blue, and white sub-pixels, respectively.

28. The device according to claim 22, wherein the display panel is a liquid crystal display panel.

* * * * *